US011634884B1

(12) United States Patent
Abulnaga

(10) Patent No.: US 11,634,884 B1
(45) Date of Patent: Apr. 25, 2023

(54) INTERNAL COMBUSTION SUBMERSIBLE DREDGING SYSTEM

(71) Applicant: Mazdak International Inc, Bellingham, WA (US)

(72) Inventor: Baha Elsayed Attia Abulnaga, Bellingham, WA (US)

( * ) Notice: Subject to any disclaimer, the term of this patent is extended or adjusted under 35 U.S.C. 154(b) by 0 days.

(21) Appl. No.: 17/658,484

(22) Filed: Apr. 8, 2022

(51) Int. Cl.

| | |
|---|---|
| ***F02D 19/10*** | (2006.01) |
| ***E02F 3/88*** | (2006.01) |
| ***F02D 19/08*** | (2006.01) |
| ***E02F 3/92*** | (2006.01) |
| *F04D 7/04* | (2006.01) |

(52) U.S. Cl.
CPC ..... *E02F 3/8883* (2013.01); *E02F 3/9225* (2013.01); *F02D 19/081* (2013.01); *F02D 19/10* (2013.01); *F04D 7/045* (2013.01)

(58) Field of Classification Search
CPC ..... F02D 19/081; F02D 19/10; E02F 3/9225; E02F 3/8883; F04D 7/045
USPC ..... 60/39.464, 461, 605.1, 597, 598, 595; 123/19, 1 A, 3, 27 GE, 559.1
See application file for complete search history.

(56) References Cited

U.S. PATENT DOCUMENTS

| | | | | |
|---|---|---|---|---|
| 1,214,791 A * | 2/1917 | Humphrey | ..... | F04F 1/18 417/54 |
| 1,272,269 A * | 7/1918 | Humphrey | ..... | F02B 71/04 417/341 |
| 2022/0205384 A1* | 6/2022 | Abulnaga | ..... | F04B 17/05 |

* cited by examiner

*Primary Examiner* — Hai H Huynh

(57) ABSTRACT

Water Reservoirs and wetlands are a major source of methane emissions contributing to greenhouse gases. The annual flood seasons contribute to movement and accumulation of sediments behind irrigation and hydropower dams. These sediments accumulate year after year, lead to loss of water storage capacity and ability to produce hydro-electricity. The invention being proposed to dredge deep sediments from reservoirs operates on the principle of using gaseous fuel from an external pipeline or collected methane emissions as fuel for a submersible internal combustion slurry system. The invention combines the features of an internal combustion liquid piston engine with a slurry turbine driving a dredging cutter. Slurry entering into the system forms a column that is set in oscillation through the explosion of air and fuel and is then pumped to shore.

3 Claims, 4 Drawing Sheets

INTERNAL COMBUSTION SUBMERSIBLE DREDGING SYSTEM

FIELD OF THE INVENTION

The invention encompasses methods, systems, and devices for dredging sediments from water reservoirs and wetlands while simultaneously burning the methane emissions and gases entrapped in the sediments, or through the use of an external gaseous fuel

BACKGROUND TO THE INVENTION

The construction of dams and reservoirs over the last two centuries has led to the accumulation of sediments in large volumes estimated to be of the order of 7000 billion cubic meters on a world scale. The silting of reservoirs reduces the live storage capacity for water, and reduces the ability to produce hydro-electricity. Silted sediments provide an environment for fermentation of organic matter leading to emissions of methane, reaching 22% of the emissions from the earth causing green-house gases. Methane emissions are more dangerous than carbon dioxide emissions.

The internal combustion liquid piston pump engine was initially developed by Humphrey (1909). The engine operates on the explosion of a mixture of gaseous fuel and air, and uses an oscillating column as the momentum instead of a flywheel.

Abulnaga (1991) a developed a liquid piston engine that incorporated a constant rotation turbine such as a Savonius rotor or a Darrieus rotor between two cylinders operating in alternating stroke.

Dredging at great depths in excess of 50 m is often considered difficult and dangerous with electric submersible pumps in the presence of methane pockets entrapped in sediments.

Sediments accumulation in reservoirs constitute traps for the emission of methane (Maeck et al (2013)) They examined a number of reservoirs in Europe and noted an increase on the average from 0.23 mmol $CH_4/m^2$/day for freshwater bodies to 19.7 mmol $CH_4/m^2$/day in dams due to trapping by sediments. They estimated that dams therefore increase world emissions of methane by 7%.

Methane is produced in lakes and reservoirs from degradation of organic matter in sediments. Methanogenesis is the process of producing methane by microbes known as methanogens. The decomposition occurs in the absence of oxygen using the Carbon in organic matter under anoxic conditions. Archae cells (not to be confused with bacteria) obtain their energy by stoichiometric conversion of substrates such as $H_2$+CO, formate, acetate, methanol, or methylamines to $CH_4$ gas. DelSontro et al (2010) showed that extreme emissions of methane occurred in a hydropower reservoir in Switzerland, a country not considered tropical. Their work over a year indicated that the total methane emission from Lake Wohlen was on average larger than 150 mg $CH_4/m^2$/day, which is the highest ever documented for a midlatitude reservoir. The substantial temperature-dependent methane emissions discovered in this 90-year-old reservoir indicate that temperate water bodies can be an important but overlooked methane source.

In a paper "Tapping Freshwaters for Methane and Energy", Bartosiewicz, Rzepka and Lehman (2021) indicated that levels of atmospheric methane $CH_4$ have tripled over the last century from pre-industrial times. They estimated that methane was 80-100 times more potent in terms of greenhouse effects than $CO_2$. They estimated that lakes and water reservoirs contribute to 92 to 142 Tg of $CH_4$ per year or 20% world emissions of methane (1 Tg=1 million metric tonne). Rivers and wetlands contribute to 35% of the emissions of the Earth at 143 to 291 Tg/year of $CH_4$.

Bartosiewicz et al point out that the emissions from reservoirs is only a fraction of the methane produced in the sediments, Therefore they estimated that the annual production of methane in reservoirs, lakes, wetlands and other freshwaters was around 469 and 865 Tg/year. If this amount of methane could be collected at 75% efficiency, the authors estimated that the global production of methane from fresh waters was equivalent to 50 to $100\times10^{11}$ kWh. By considering that the worldwide production of electricity in 2018 reached $23\times10^{12}$ kWh, the authors made the case that there could be sufficient methane to tap to cover as much as energy needed.

The authors also conducted a more conservative bottom-up calculations. They assumed a gross sedimentary efflux (by diffusion only) of 10 mmol/$m^2$/day for rivers, lakes and reservoirs, and 250 mmol/$m^2$/day for wet lands, and considering that the global surface area of freshwater was of the order of $1.75\times10^7$ $km^2$, they calculated a total amount of $CH_4$ released from freshwater sediments of the order of $190\times10^{12}$ kWh/year. They also estimated that the rate of sedimentary $CH_4$ production is bound to increase in the future as consequence of eutrophication, global warming and proliferation of anoxia.

In a recent study, J. Harrison et al (2021), scientists from Washington State University and University of Quebec at Montreal. showed per-area greenhouse gas emissions from the world's water reservoirs were around 29% higher than suggested by previous studies. They attributed the increase to methane degassing, a process where methane passes through a dam and bubbles up downstream.

Decomposing plant matter near the bottom of reservoirs fuels the production of methane, a greenhouse gas that is 25 to 34 times more potent than carbon dioxide over the course of a century and comparable to rice paddies or biomass burning in terms of overall emissions.

Harrison and colleagues found methane degassing accounts for roughly 40% of emissions from water reservoirs. This large increase in previously unaccounted for emissions was partly offset by a projected lower amount of methane diffusing off the surface of reservoirs, according to the analysis. Carbon dioxide emissions were similar to those reported in past work.

The idea of using $CH_4$ extracted from deep reservoirs is not new. A deep stratified lake, Kivu Lake, one of the great lakes of Africa, is approximately 90 km (56 mi) long and 50 km (31 mi) at its widest. It covers an approximate surface area of 2,700 $km^2$. Gas is extracted from deep waters (>260 m to 300 m), collected and scrubbed. It is estimated to have 60 billion cubic meters of methane and 300 billion cubic meters of carbon dioxide. These harmful gases were expected to saturate the lake in 50 to 200 years causing gas eruption threats to surrounding populations on the shores A plant was built in 2016 to produce 26 MW, and is being upgraded to produce 34 MW, with plans to install a further 75 MW plant. The first phase consisted of an investment of $142 million and the second phase was budgeted for $180 million. The first phase plant consisted of a 750 ft floating barge integrating a gas extraction and treatment facility (Power Technology)

The bottom of lake Tanganyika in Tanzania, is also estimated to store 23 Tg of $CH_4$. Shema Power Lake Kivu (2021) is also developing a new 56MW Methane Gas to Power Generation plant in the Ribavu district of Rwanda.

The development of technologies to harvest methane in the USA has been limited to recovery from landfills or wastewater treatment plants. Therefore, there is no commercial project at present to recover from hydropower reservoirs. Bartosiewicz et al (2021) propose that adsorption-based technologies be developed as they would be less capital intensive than compression or liquefaction approaches. A hydrophobic gas-liquid membrane contactor (GLMC) is therefore proposed. The membrane allows gas molecules to pass while preventing water to flow. They state that microporous polymer-based membranes have successfully employed in large-scale methane recovery from anaerobic effluent upon biogas upgrading and have been tested for large wastewater treatment plants. One type, called hollow fibers ultrafiltration achieves 53% separation efficiency on digestion of sludge from urban wastewater to 98% on synthetic $CH_4$ rich wastewater streams. The authors suggest that membrane manufactured from polytetrafluoroethylene (PTFE) or polyvinylidene fluoride (PVDF) would be of particular interest to recover methane from freshwater sources, because of their high resistance to wetting and their particularly high $CH_4$ flux rate or mass transfer rate.

It is therefore my belief that technologies are needed for capturing methane emissions from wet lands and water reservoirs, but considering the large accumulation of sediments behind dams, the fuel should be used directly towards dredging the very same sediments that entrap the methane. Our invention focuses on the combustion of the methane in an internal combustion liquid piston engine with capabilities to dredge.

About 65% of the reservoirs of water in the United States are not producers of hydro-electricity. Many are close to natural gas pipelines. Therefore, the invention can be operated on natural gas.

There are many deep reservoirs where electric submersibles do not perform well and must be removed in the presence of a methane pocket. Methane also causes cavitation of centrifugal pumps, while our proposed invention would not suffer from such a problem.

REFERENCES a. Abulnaga B. E, 1991. An internal combustion engine featuring the use of an oscillating column and hydraulic turbine to convert energy of fuel—Australian patent 607796 b. Abulnaga B. E. 2021—"Slurry Systems Handbook" McGraw-Hill—2$^{nd}$ Edition— c. Humphrey H. A. 1909 "An Internal Combustion Pump and Other Applications of a New Principle"—Proceedings of the Institution of Mechanical Engineers, Vol 77, No-1, 1909, pp 1075-2000 d. U.S. Pat. No. 1,272,269 "Utilizing an Expansive Force in the movement of liquid"—Issued Jul. 9, 1918.

e. U.S. Pat. No. 1,214,791 Methods of Raising or Forcing Liquids—issued Feb. 6, 1917Akbari P, B. Gower and N. Müller. 2012. Thermodynamics of the Wave Disk Engine.

f. Bartosiewicz M. P. Rzepka and M. F. Lehman 2021. Taping Freshwaters for Methane and Energy *Environ. Sci. Technol.* 2021, 55, 8, 4183-4189—https:/dx.doi.org/10.1021/acs.est0c06210Dealing with Sediment: Effects on Dams and Hydropower Generation—Hydro Review Issue 1 Volume 25—Published Feb. 22, 2017—https://www.hydroreview.com/2017/02/22/dealing-with-sediment-effects-on-dams-and-hydropower-generation/#gref.

g. DelSontro T.; McGinnis, D. F.; Sobek, S.; Ostrovsky, I.; Wehrli, B. Extreme methane emissions from a Swiss hydropower reservoir: contribution from bubbling sediments. Environ. Sci. Technol. 2010, 44 (7), 2419-2425.

h. John A. Harrison, Yves T. Prairie, Sara Mercier-Blais, Cynthia Soued. Year-2020 Global Distribution and Pathways of Reservoir Methane and Carbon Dioxide Emissions According to the Greenhouse Gas from Reservoirs (G-res) Model. *Global Biogeochemical Cycles,* 2021; DOI: 10.1029/2020GB006888 i. Humphrey H. A. 1909 "An Internal Combustion Pump and Other Applications of a New Principle"—Proceedings of the Institution of Mechanical Engineers, Vol 77, No-1, 1909, pp 1075-2000doi:10.1002/2013EF000184.

j. Maeck A, Hofmann H, Lorke A (2014) Pumping methane out of aquatic sediments: ebullition forcing mechanisms in an impounded river. Biogeosciences 11:2925-2938. doi:10.5194/bg-11-2925-2014 k. Maeck A, Del Sontro T, McGinnis D F, Fischer H, Flury S, Schmidt M, Fietzek P, Lorke A (2013) Sediment trapping by dams creates methane emission hot spots. Environ Sci Technol 47:8130-8137. doi:10.1021/es4003907 l. Martinez D, Anderson M A (2013) Methane production and ebullition in a shallow, artificially aerated, eutrophic temperate lake (Lake Elsinore, Calif.). Sci Total Environ 454:457-465. doi:10.1016/j.scitotenv.2013.03.040 m. McClauchlan. J. I. 1932. The Humphrey Pump and the installation of Two Sixty-Six Inch Units at Cobdogla, River Murray. Transactions of the Institution of Engineers of Australia)

n. Miller A. (2008) Humphrey Pumps & Cobdogla Pumping Station, Cobdogla, S.—A submission to Engineering Heritage, Australia for a National Engineering Landmark Morris, G. L. and Fan, J. (1998).

o. Power Technology https://www.power-technology.com/projects/kivuwatt-project-lake-kivu-kibuye/

SUMMARY OF THE INVENTION

The invention consists of a submersible system that can be sunk at great depth to dredge sediments from reservoirs. The invention features a dredging cutter, operated by a turbine immersed in an oscillating column of dredged slurry whose oscillation is induced by the periodic explosion of a mixture of compressed air and a gaseous fuel such as natural gas provided from shore or methane emissions collected in the reservoir.

DETAILED DESCRIPTION OF THE INVENTION

Figure 1:
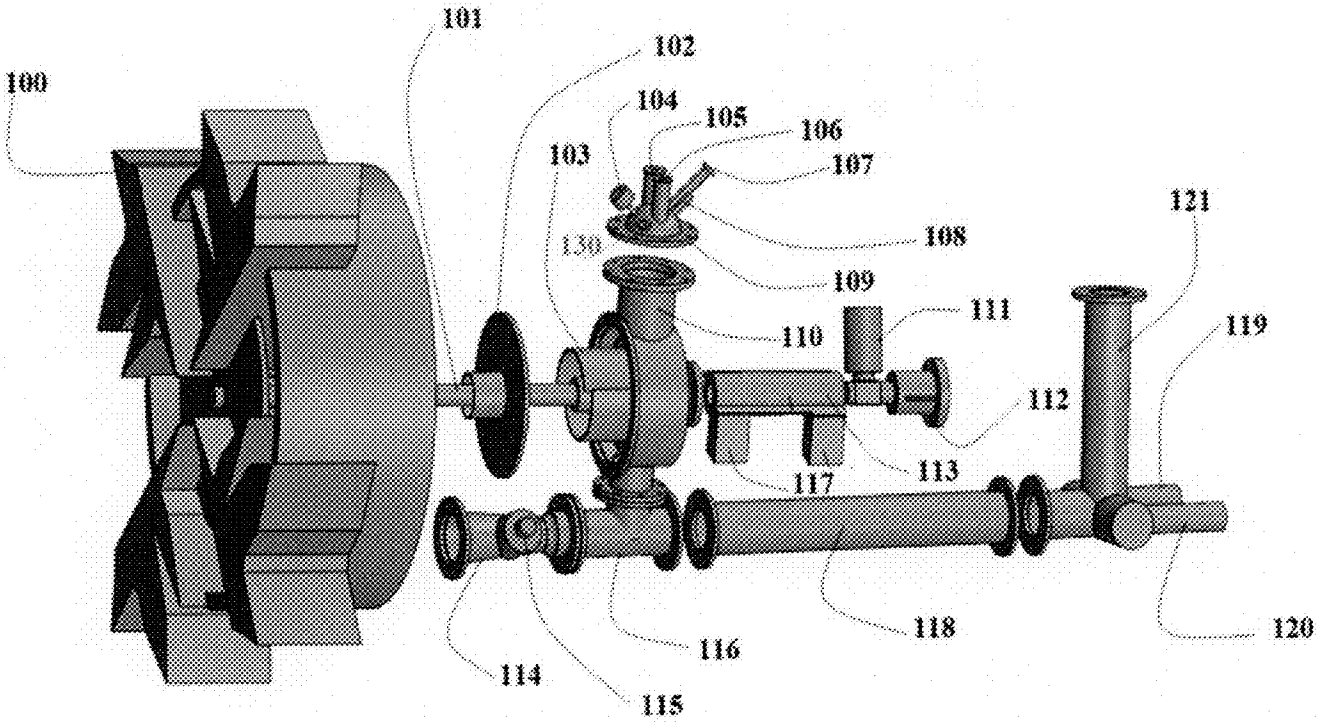
FIG. 1 presents an exploded view of the invention with principal components

FIG. 1 presents an exploded drawing of the invention. The cutting of sediments is achieved through a cutter (100) mounted on a shaft (101), driven by a uni-directional turbine (103) capable of maintaining a constant direction of rotation irrespective of the oscillation of slurry in the cylinder (109). On top of the cylinder, an engine head (109) is bolted, featuring a gaseous fuel connection (107), an inlet/scavenger valve piping/solenoid system (105), an exhaust valve piping/solenoid system (106), a spark igniter (108), and a pressure transducer (104). The combustion occurs in a cylinder and turbine casing (110) As the cutter (100) cuts through sediments and water, it forms a slurry that enters the invention through a slurry check valve (114), such as a swing check valve with a position indicator (115). The slurry enters the turbine casing (110) through a pipe fitting (116) during filling and compression strokes but leaves following the explosion of the air and fuel mixture during the expansion stroke into a horizontal pipe (118) towards the final discharge piping (121). The shaft for the turbine and cutter is (supported by a bearing assembly (113) and pedestal (117). The shaft drives a compressor (111) and an alternator (112), by direct drive or through a gear box. The compressor provides the necessary air pressure to enter the engine through the scavenger/air valve and overcome the hydrostatic pressure of water at the depth of immersion. The fuel pressure is also adjusted to overcome the hydrostatic pressure from the fuel pipeline. For mobile systems, two jet connections (119) and (120) are installed at the rear of the discharge pipe, to use some of the energy of the pumped slurry for thrust and control by differential flow in each connection. The scavenger air valve is operated as a solenoid or as a valve with a spring. The exhaust valve may be a solenoid or a valve with a return spring operated by a push rod from the check valve.

Figure 2:
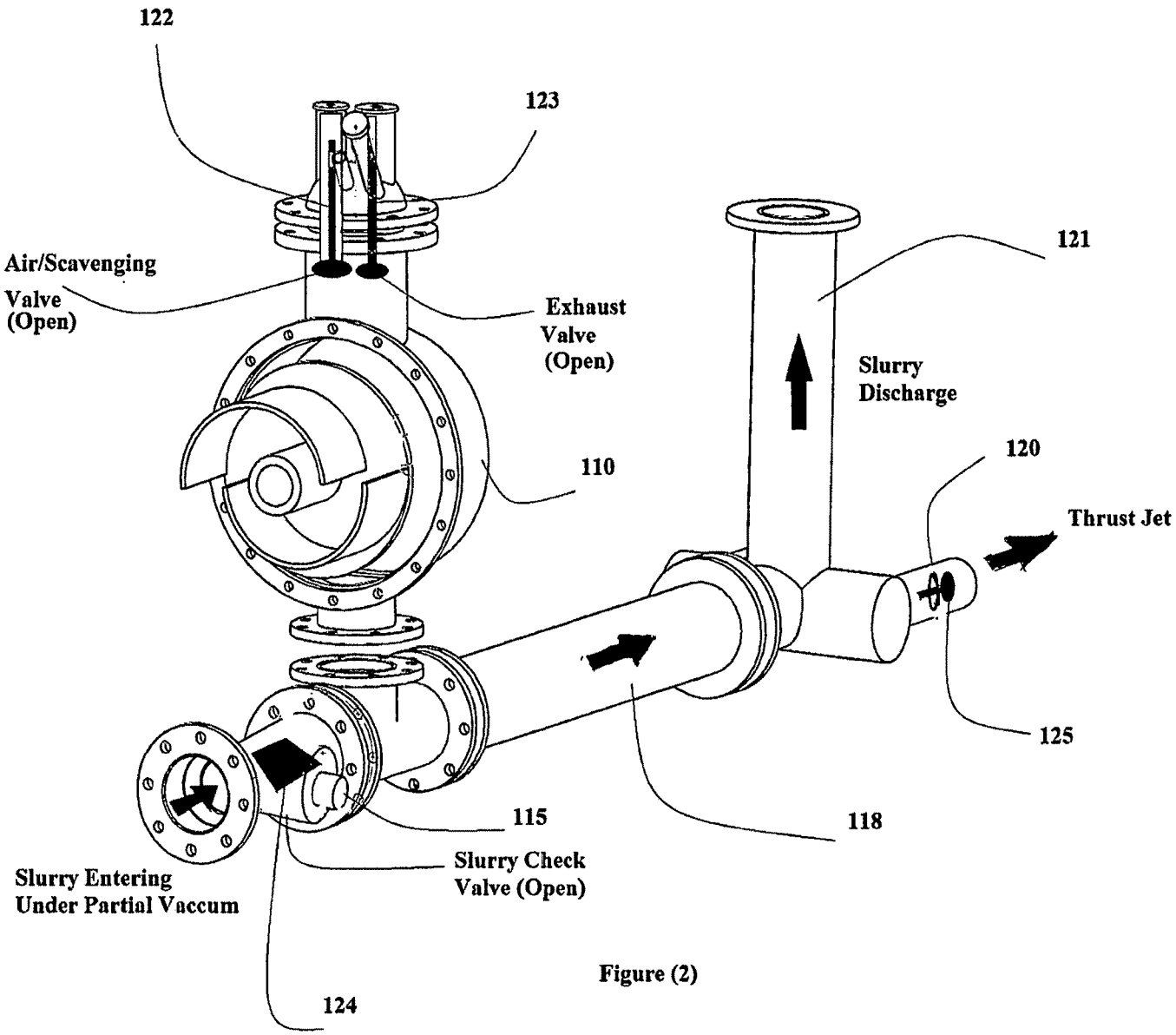
FIG. 2 presents the first stroke of operation of the invention after the explosion of the air and fuel mixture

FIG. 2 shows operation after explosion of the air and fuel mixture like a slurry canon. The slurry leaves through discharge pipe (118), The check valve (124) opens and transmits its position through the transducer (115) causing the exhaust valve (122) to depress and open for exhaust and product of combustion to leave The pressure transducer (104) records low pressure and partial vacuum. The scavenging valve (124) starts to open under partial vacuum. This causes the PLC to send a signal to the solenoid valve on the compressor (111) to open and inject fresh air through the air/scavenging valve (123). For mobile units some slurry leaves as a jet through check valve (125). For stationary units, the discharge (119) and (120) are sealed.

Figure 3:
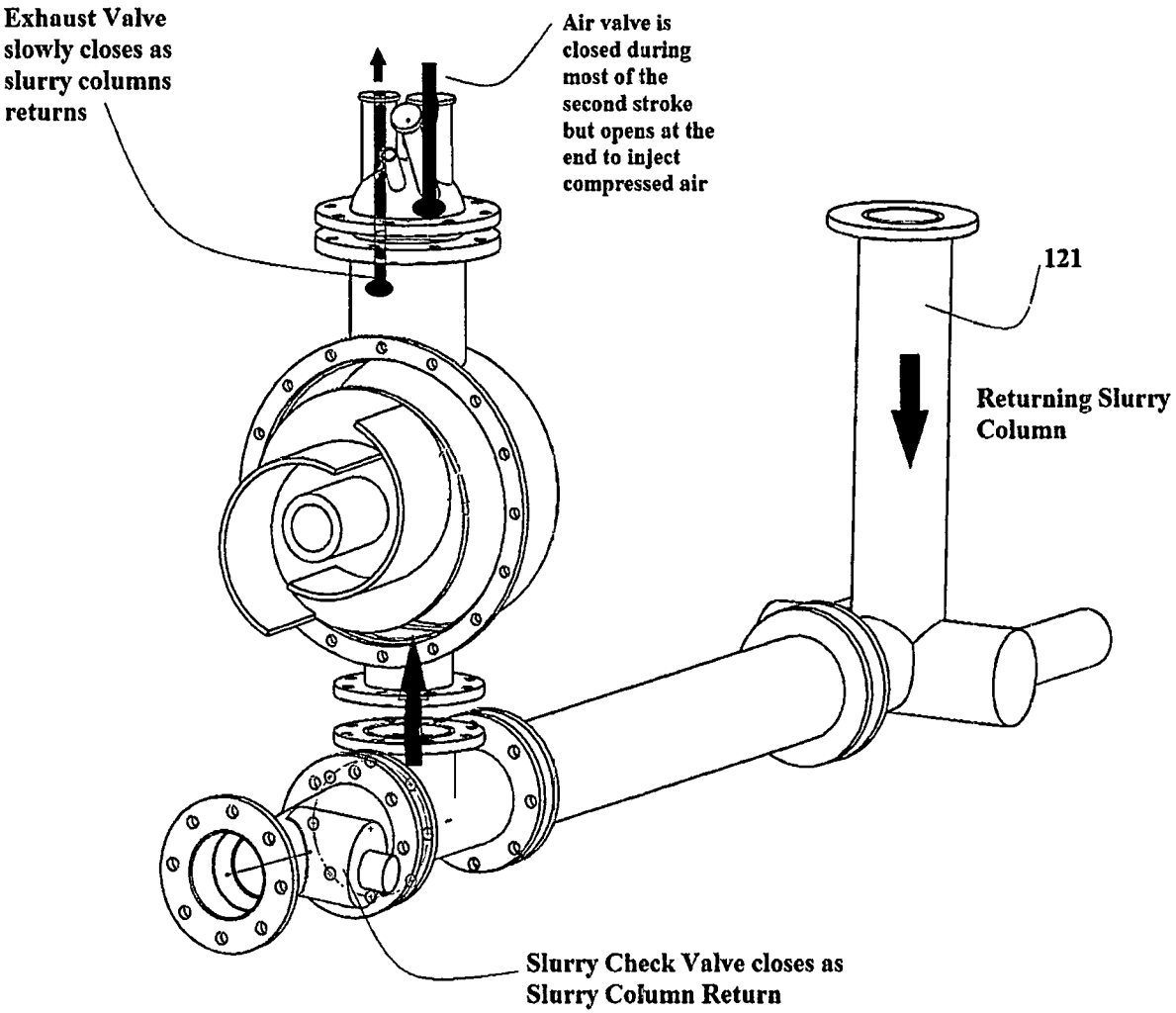
FIG. 3 presents the second stroke of operation of the invention with the return column of dredged slurry

FIG. 3 Shows the first return stroke. After discharging some the slurry, the rest of the column falls under its own weight through column (121) into pipe (118) and pushes back on the slurry check valve (124) forcing it to close, that in turns forces the exhaust valve (122) to close. In the process the slurry that rises through the turbine casing and cylinder (110) causes the Savonius turbine (103) to rotate and operate the dredging cutter (100). At the end of the stroke, as the angular transducer (115) indicates that the check valve is fully closed and the PLC confirms that the exhaust valve system (106) is fully shut, the PLC opens the air solenoid valve from the compressor and the solenoid valve on the fuel (107). The air and fuel are then ignited using the ignition system (108) resulting in an expansion of the gases and forcing the slurry column through the turbine back into the discharge pipe.

Figure 4:
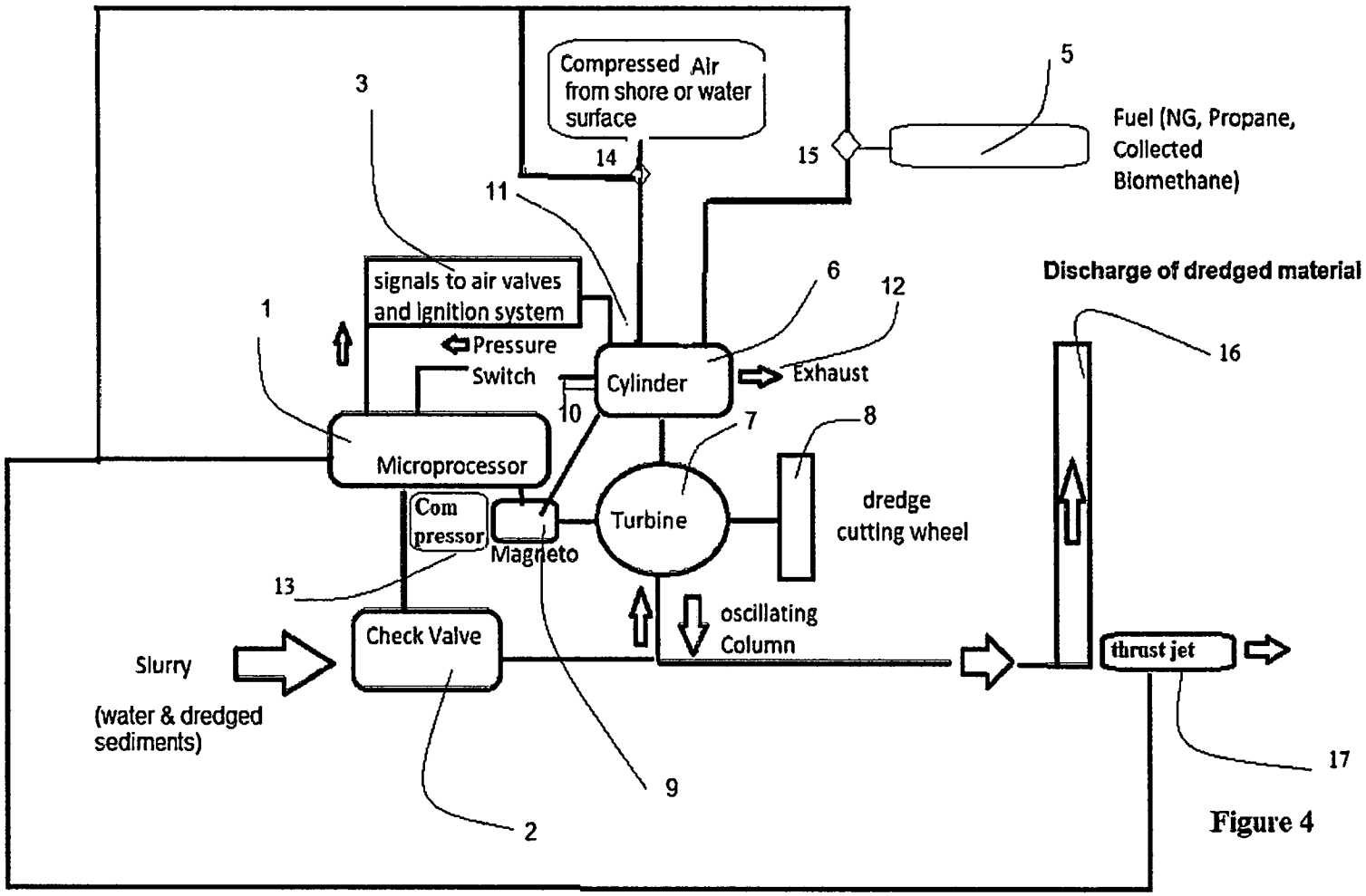
FIG. 4 presents a block diagram for control of the invention

FIG. 4 shows a block diagram for control of the submersible through a microprocessor (1). The microprocessor receives a signal from the inlet check valve (2) to control the opening and closure of the exhaust valve (12). The microprocessor receives data from the pressure switch (10) to send signals to air valves and ignition system Ignition is generated from the magneto (9). The turbine (7) under the cylinder, operates the dredge cutting wheel (8) Information about cutting torque can be transmitted back to the microprocessor. Compressed air is supplied from shore through a pipeline (4) but can also be boosted through a compressor (13) The microprocessor controls valves (14) on compressed air and valves (15) on fuel lines Slurry leaves through a discharge pipe (16), For mobile units a signal is sent from the microprocessor to control the directional thrust jet (17)

What is claimed is:

1. A submersible internal combustion system for dredging incorporating a dredging cutting wheel, driven by a unidirectional flow turbine capable of maintaining a constant direction of rotation through the passage of an oscillating column of dredged slurry, set in motion and oscillation through the explosion of a mixture of compressed air and a gaseous fuel, such as natural gas, propane or methane emissions collected from the reservoir, and where the compressed air and fuel pressure are adjusted to the hydrostatic pressure of water at the depth of immersion of the submersible, and where the column of slurry is discharge to surface through a principal discharge pipe, and through side jets to provide motion and steering of the submersible.

2. A submersible internal combustion system for dredging operating on two strokes, where by the first stroke occurs after the explosion of the gas and fuel mixture, setting in motion a column of dredged slurry in a cylinder through a turbine, and allows a fresh quantity to enter through a slurry check valve fed by the dredging cutting wheel, while simultaneously opening exhaust valves and scavenging valves to expulse the products of combustion, and pumping a quantity of dredged slurry.

3. A submersible internal combustion system for dredging operating on two strokes, where by the second stroke occurs as the slurry column reverses motion under its own weight after delivering a quantity of dredged slurry to shore, and causes the inlet check valve of the submersible to close while rising through the turbine casing and cylinder and causing the closure of the exhaust valve through its link to the slurry check valve, and whereby at the end of the stroke, compressed air and fuel are injected to match the hydrostatic pressure in the cylinder of water due to the depth of immersion of the engine, followed by ignition and expansion of the products of combustion to initiate the reverse of dredged material column and its rise through the discharge pipe passing through the unidirectional turbine and maintaining the rotation of the cutter.

* * * * *